US006357988B1

(12) United States Patent
Bayne

(10) Patent No.: US 6,357,988 B1
(45) Date of Patent: Mar. 19, 2002

(54) SEGREGATED WASTE COLLECTION SYSTEM

(75) Inventor: Jimmy O. Bayne, Anderson, SC (US)

(73) Assignee: Bayne Machine Works, Inc., Greenville, SC (US)

( * ) Notice: Subject to any disclaimer, the term of this patent is extended or adjusted under 35 U.S.C. 154(b) by 0 days.

(21) Appl. No.: 09/451,062

(22) Filed: Nov. 30, 1999

Related U.S. Application Data

(60) Provisional application No. 60/110,362, filed on Nov. 30, 1998.

(51) Int. Cl.[7] ..... B65F 3/04

(52) U.S. Cl. ..... 414/408; 220/555; 222/166

(58) Field of Search ..... 414/399, 403, 414/404, 406, 407, 408, 409, 584; 220/553, 555; 222/166

(56) References Cited

U.S. PATENT DOCUMENTS

| | | | | |
|---|---|---|---|---|
| 3,762,586 A | | 10/1973 | Updike, Jr. | |
| 4,773,812 A | | 9/1988 | Bayne et al. | |
| 5,035,563 A | | 7/1991 | Mezey | |
| 5,116,184 A | * | 5/1992 | Pellegrini | 414/406 |
| 5,163,805 A | | 11/1992 | Mezey | |
| 5,205,698 A | | 4/1993 | Mezey | |
| 5,222,853 A | * | 6/1993 | Carson | 414/408 |
| 5,303,841 A | | 4/1994 | Mezey | 220/555 |
| 5,308,211 A | | 5/1994 | Bayne | |
| 5,333,984 A | | 8/1994 | Bayne et al. | |
| 5,344,273 A | * | 9/1994 | Radlein | 414/409 |
| 5,447,405 A | | 9/1995 | Bayne et al. | |
| 5,458,452 A | * | 10/1995 | Pellegrini | 414/406 |
| 5,503,512 A | | 4/1996 | Bayne | |
| 5,613,823 A | | 3/1997 | Bayne | |
| 5,681,140 A | * | 10/1997 | Christenson | 414/525.6 |
| 5,762,462 A | | 6/1998 | Bayne | |
| 5,784,947 A | | 7/1998 | Bayne et al. | |
| 5,823,728 A | * | 10/1998 | Veldman et al. | 414/510 |
| 6,077,020 A | * | 6/2000 | Neufeldt et al. | 414/399 |

FOREIGN PATENT DOCUMENTS

| | | | |
|---|---|---|---|
| DE | 2228503 | 1/1974 | |
| EP | 0405345 A1 | 1/1991 | |
| FR | 2459768 | 1/1981 | |
| FR | 2479783 | 10/1981 | |
| WO | WO 98/16447 * | 4/1998 | 414/399 |

OTHER PUBLICATIONS

Partial European Search Report, EP 00 20 0062, The Hague, mailed Jun. 19, 2000.

* cited by examiner

*Primary Examiner*—Robert P. Olszewski
*Assistant Examiner*—Gerald J. O'Connor
(74) *Attorney, Agent, or Firm*—Dority & Manning

(57) ABSTRACT

A divided cart has plural waste compartments and a divided intermediate transfer container has corresponding plural compartments. A deflector assembly on the intermediate transfer container deflects waste into the respective compartments as the divided cart is dumped. The deflector assembly is movable, such as comprised of flexible material, to also deflect waste in its segregated state into further corresponding compartments of a waste collection vehicle. A lift mechanism carried on the intermediate transfer container has a lifting plate which positions the divided cart so that contents of its plural waste compartments dump respectively into the corresponding plural compartments of the divided intermediate transfer container.

27 Claims, 7 Drawing Sheets

SEGREGATED WASTE COLLECTION SYSTEM

PRIORITY CLAIM

Priority is claimed based on provisional application Ser. No. 60/110,362 filed Nov. 30, 1998.

BACKGROUND OF THE INVENTION

1. Field of the Invention

The invention relates to a segregated waste collection system and, more specifically, to a segregated waste collection system having a divided waste cart, defining separate compartments for holding segregated waste, in combination with a divided collection container having corresponding separate compartments for receiving the segregated waste from the divided cart compartments.

2. Description of the Related Art

Segregated waste collection systems are typically used when both recyclable and non-recyclable waste is simultaneously collected. In segregated waste collection systems, it is common to provide a user with a divided waste container, having a dividing wall defining one compartment for recyclable waste and another compartment for non-recyclable waste. A cover for each of the compartments is hingedly mounted to the divider wall in the container and performs the dual function of covering the associated compartment and deflecting the contents of the compartment when the cart is dumped. The waste cart is typically lifted with a mechanical device and inverted so that the compartments within the waste cart overlie corresponding compartments in a waste collection vehicle. As the cart is inverted, the covers open in response to gravity and serve to deflect the contents emptying from the compartments of the cart into the corresponding compartments of the waste vehicle. Examples of such a waste collection system are illustrated in U.S. Pat. Nos. 5,035,563, issued Jul. 30, 1991, U.S. Pat. No. 5,163,805, issued Nov. 17, 1992, U.S. Pat. No. 5,205,698, issued Apr. 27, 1993, and U.S. Pat. No. 5,303,841, issue Apr. 19, 1994.

One disadvantage of the prior art segregated waste collection system is there is frequently cross contamination of the contents of one cart compartment into cross compartments in the waste vehicle. Another disadvantage is that the cart construction and use becomes increasingly more complex and difficult, especially as the number of compartments increase beyond two, as compared to a traditional cart with a single cover for all the compartments.

SUMMARY OF THE INVENTION

According to the invention, a divided cart has a single cover and a divided waste storage container has deflectors to deflect the waste stored in the divided cart into the appropriate compartments in the divided waste storage container.

In a preferred embodiment, the divided waste storage container is an intermediate size container adapted to be lifted and dumped into a waste collection vehicle. At least one divider wall divides the intermediate size container into multiple compartments A movable deflector is provided on the intermediate size container divider wall to deflect the waste spilling from the divided cart into the corresponding compartments in the intermediate size container. In the dump position, the deflectors can be moved to a second position where they deflect the waste spilling from the intermediate size container into corresponding compartments in the waste vehicle.

BRIEF DESCRIPTION OF THE DRAWINGS

The invention will now be described with reference to the drawings in which.

DETAILED DESCRIPTION OF THE PREFERRED EMBODIMENTS

Figure 1:
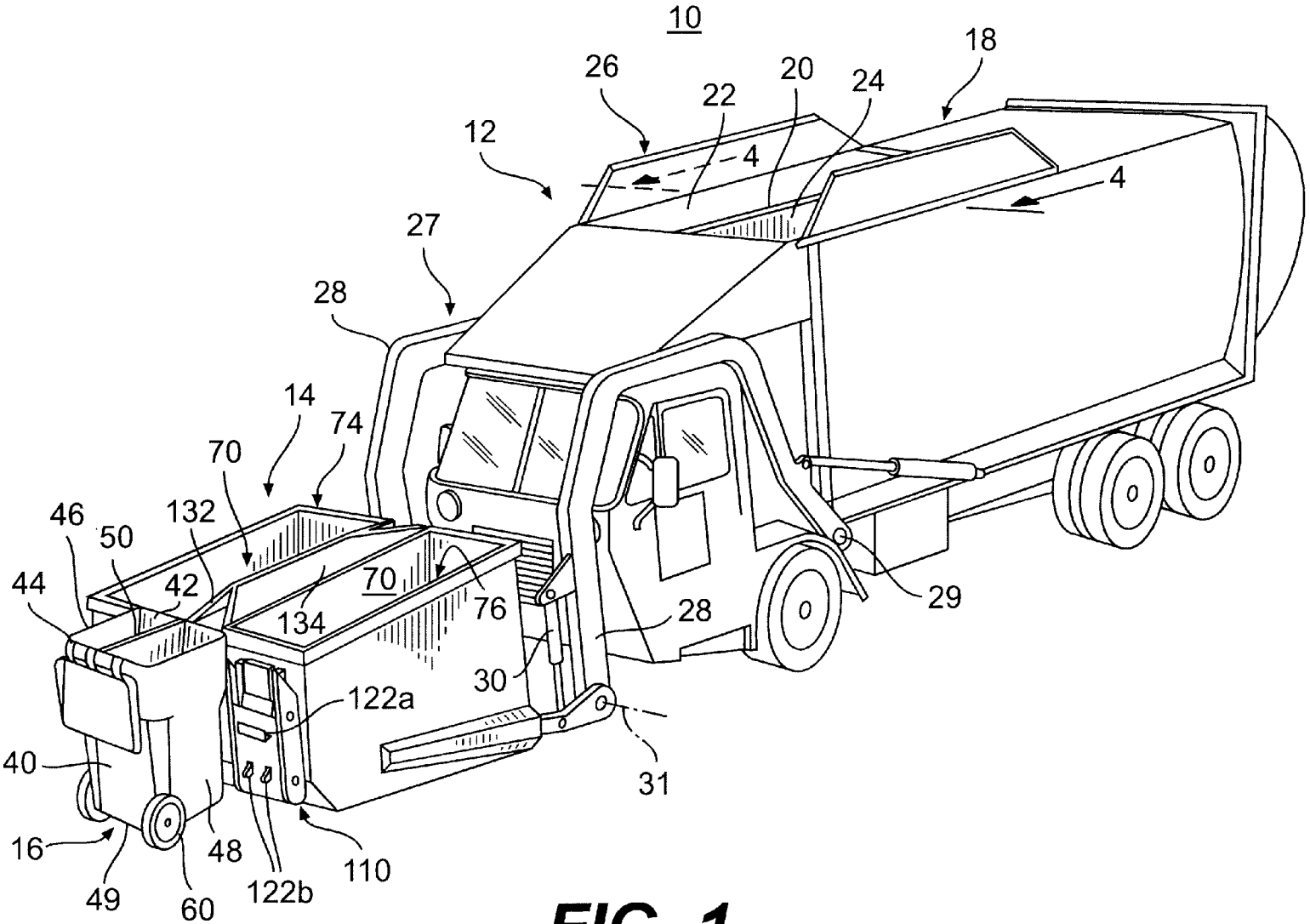
FIG. 1 is a perspective view of a segregated waste collection system including a waste collection vehicle, an intermediate size container, and a divided cart according to the invention.

The segregated waste collection system 10 according to the invention comprises a waste collection vehicle 12, an intermediate size container 14 and a divided cart 16. In typical operation, the divided cart 16 is filled with waste and is emptied into the intermediate size container 14, which can hold the waste from many divided carts. The contents of the intermediate size container are ultimately emptied into the waste collection vehicle 12.

The waste collection vehicle 12 comprises a waste storage container 18 having a divider wall 20, separating the waste storage container 18 into two compartments 22, 24. One of the compartments is can used to store recyclable materials and the other compartment preferably stores non-recyclable materials. A hopper 26, on the top of the waste storage container 18, provides access to the first and second compartments 22 and 24 of the waste storage container 18.

The waste collection vehicle also comprises a hydraulic lift 27 for lifting the intermediate size container 14 from a fill position (FIG. 1) to a emptying position (FIG. 7), where the contents of the intermediate size container are emptied into the waste collection vehicle. The hydraulic lift 27 is preferably a pair of arms 28, which are rotatably mounted at one end to the waste collection vehicle for rotation about a first axis 29 and whose other end mounts to the intermediate size container 14. The end of the lift arms 28 mounting the intermediate size container include hydraulic actuators 30, which are adapted to rotate the intermediate size container about a second rotational axis 31.

Figure 2:
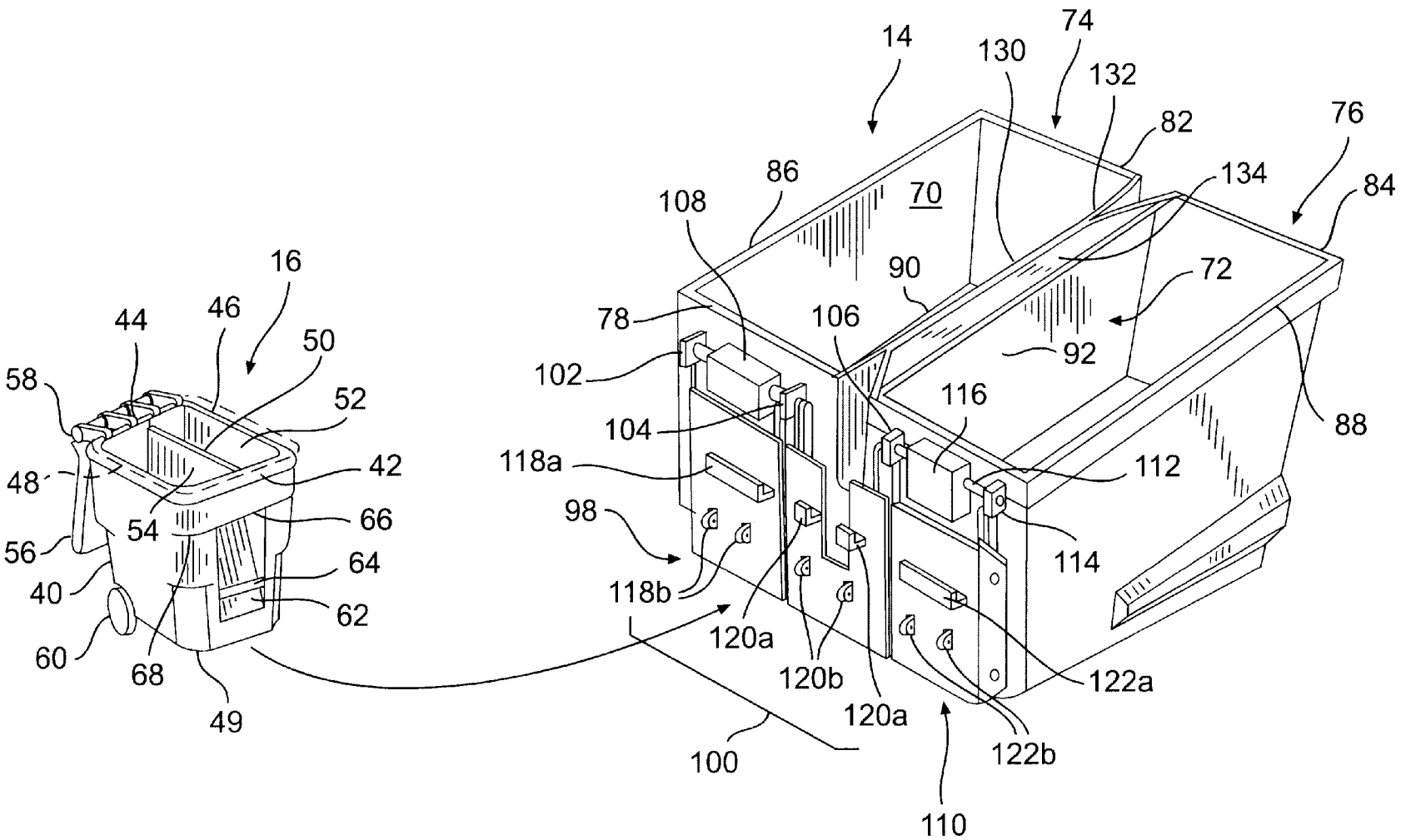
FIG. 2 is a perspective view illustrating the connection of the divided cart and intermediate size container of the invention.

Referring to FIG. 2, the divided cart 16 comprises a generally rectangular body 40 having a front wall 42, rear wall 44, opposing side walls 46 and 48 and bottom wall 49.

A divider wall 50 extends between the front wall 42 and the rear wall 44 to divide the body 40 into first and second compartments 52 and 54.

A cover 56 is hingedly mounted to a handle 58, extending from the rear wall 44. The cover 56 is adapted to close the open top of the body 40. The rear wall 44, side walls 46, 48 and bottom wall 49 all define an inset portion in which a wheel and axle assembly 60 is provided to aid in moving the divided cart 16. The front wall 42 defines an inset portion 62 across which spans a grab handle 64. An upper handle 66 is formed at the junction of a lip 68 and the inset portion 62.

The intermediate size container 14 comprises a first compartment 70 and second compartment 72, which are defined by a pair of spaced containers 74 and 76. Each of the containers has a front wall 78, 80, rear wall 82, 84, exterior side walls 86, 88 and interior side walls 90, 92, which effectively define a dividing wall between the first and second compartments 70 and 72. The containers are connected at the lower portion of the interior dividing walls 90 and 92.

A lift mechanism 98 is provided on the front walls 78, 80 and comprises a first lifting plate 100, which has a portion that spans the divider wall between the first and second container 74 and 76. Spaced support arms 102, 104, and 106 pivotally mount the first lifting plate 100 to the intermediate size container 14 by pivotally mounting one end to the rear of the first lifting plate and the other end pivotally mounted to the front walls 78, 80. A hydraulic actuator 108 is mounted to the front wall 78 and to the first lifting plate 100 to rotate the first lifting plate 100 about the pivotal connection of the arms 102, 104, 106 to the front walls 78, 80.

Similarly, a second lifting plate 10 is pivotally mounted to the front wall 80 through spaced support arms 112 and 114. A hydraulic actuator 116 is adapted to rotate the second lifting plate 110 relative to the front walls 78 and 80.

Multiple saddles 118*a*, 120*a* and 122*a* are provided on the first and second lifting plates 100 110 and are adapted to engage the upper handle 66 of the divided cart 16 to lift the cart as the lifting plates 100, 110 are raised. Multiple rotatable lower respectively, are also disposed on the lifting plates 100 and 110 The lower cart hooks 118*b*, 120*b*, 122*b* rotate to engage the grab handle 64 of the cart to prevent the cart from sliding off the lift when the cart is in the inverted position.

The three saddles 118*a*, 120*a*, 122*a* provide additional functionality to the lift mechanism 98. The saddle 118 is positioned on the first lifting plate 100 so that both compartments 52 and 54 of the divided cart 16 will be aligned with the first compartment 70 of the intermediate size container 14. Similarly, the third saddle 122*a* is positioned on the second lift 110 so that the first and second compartments 52, 54 of the divided cart 16 will be aligned with the second compartment 72 of the intermediate size container 14. The saddle 120*a*, provided on the first lifting plate 10, is substantially in line with the divider wall of the intermediate size container 14 so that the first compartment 52 of the divided cart 16 is aligned with the first compartment 70 of the intermediate size container and the second compartment of the divided cart 16 is aligned with the second compartment of the intermediate size container 14. The several saddles provide for the emptying of the entire contents of the divided cart 16 into one of the compartments of the intermediate size container or segregating the contents of the divided cart 16 into the corresponding compartments of the intermediate size container. This increased functionality is very useful and advantageous in that not all users of the divided divided cart 16 separate their waste into recyclable and non-recyclable. Further, two undivided carts can be dumped simultaneously into the intermediate container 14 with the lift mechanism 98.

Figure 3:
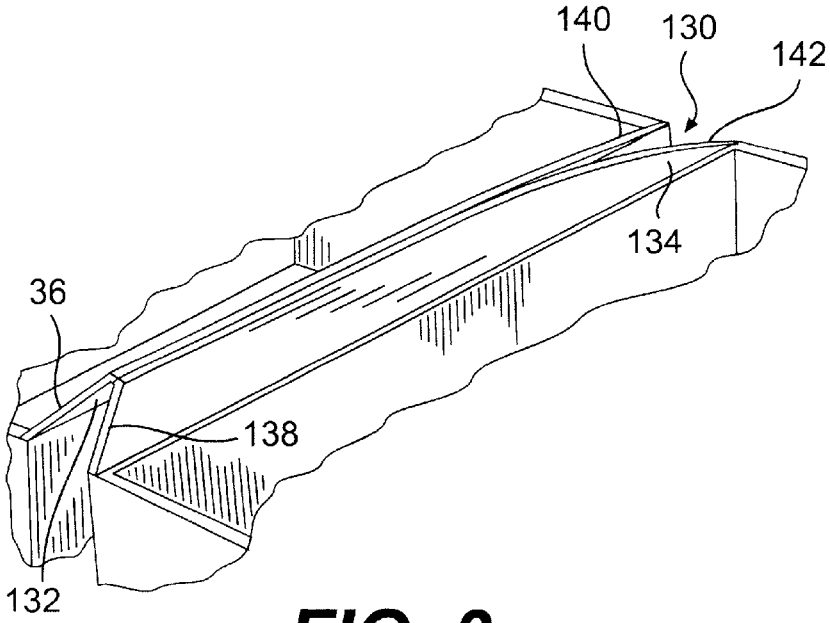
FIG. 3 is an enlarged view of the intermediate size container shown in FIG. 1 and illustrating the deflectors in a filling position.
Figure 4:
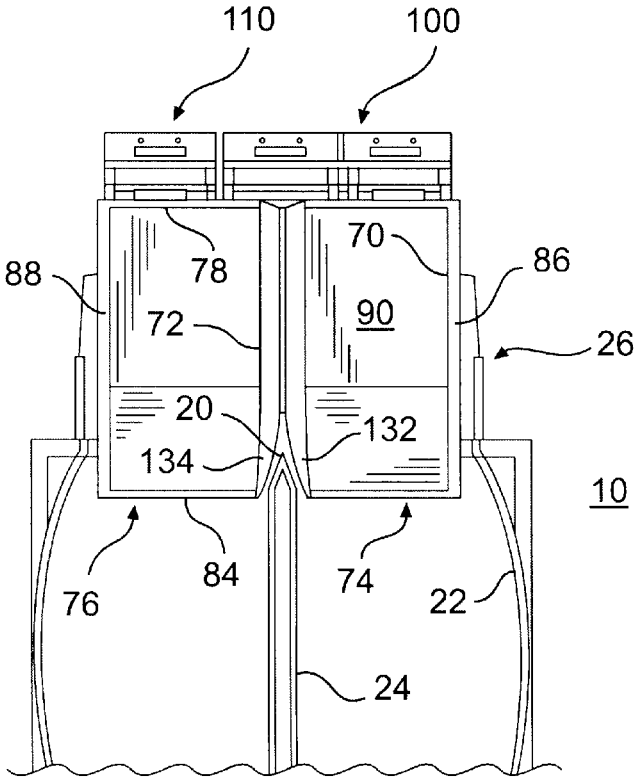
FIG. 4 is an enlarged partial view of FIG. 1 in the emptying position and the intermediate size container illustrating the interface between the deflector and the waste collecting vehicle.
Figure 5:
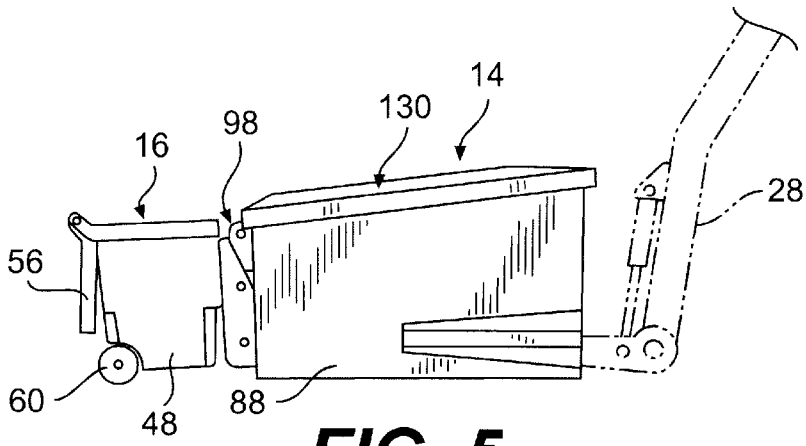
FIG. 5 is a side view of the divided cart connected to the intermediate size container with the divided cart in a loading position.
Figure 6:
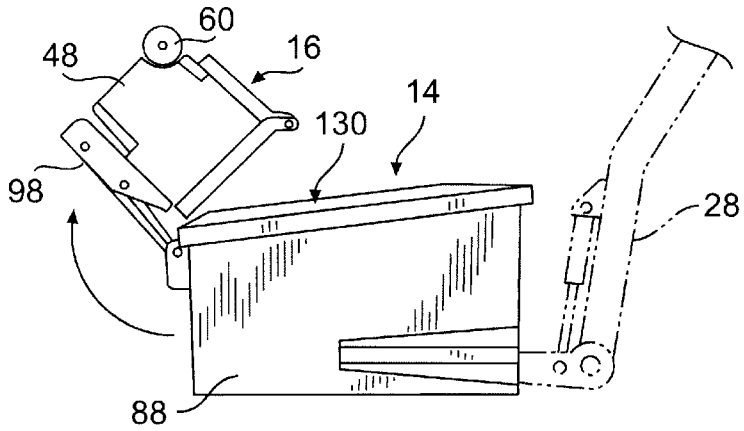
FIG. 6 is similar to FIG. 5 except that the divided cart is shown in the emptying position.
Figure 7:
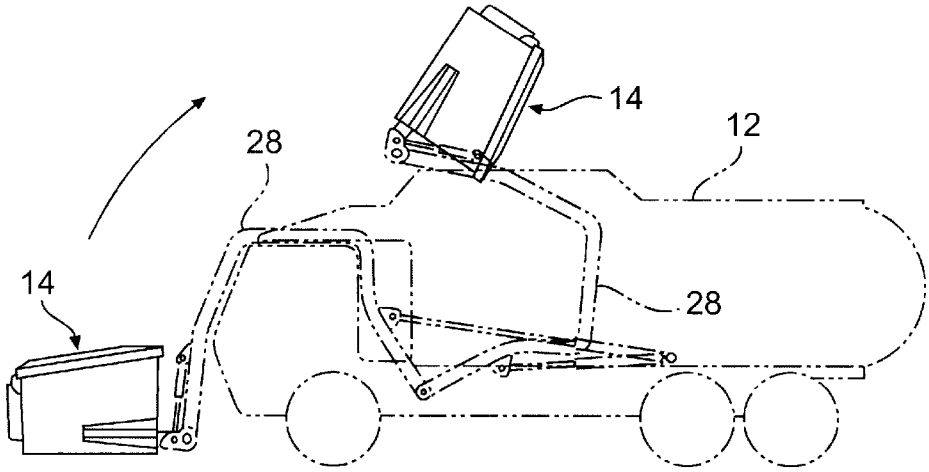
FIG. 7 is a side view of the intermediate size container in an emptying position relative to the waste-receiving vehicle.

Referring to FIGS. 2–4, the intermediate size container 14 has a deflector assembly 130 comprising a pair of blades 132, 134. The blades 132, 134 have sharply angled leading edges 136, 138 and more gently angled trailing edges 140, 142. The trailing edges 140, 142 preferably have an increasing angle relative to the upper edge of the walls 90, 92. The increasing railing edge angle defines a tapered opening between the trailing edges 140, 142 to aid in positioning the divider 20 of the storage container 18 between the blades 132, 134 when the intermediate size container 14 is in the emptying position (FIG. 7)

The blades 132, 134 are preferably made from a flexible material, such as high density polyethylene (HDPE) and the like. The blades 132, 134 are mounted to the upper edge of the walls 90, 92 by threaded bolts (not shown) passing through the blades 132, 134 and walls 90, 92, respectively, with nuts threaded on the end of the bolts. Any other suitable fastener can also be used, such as mechanical fasteners. Preferably, the blades 132, 134 are removably mounted for easy replacement.

In operation, a divided cart 16 containing, for example, recyclable material in one compartment and non-recyclable material in another compartment is moved to the leading position by wheeling the intermediate size container 14 mounted to the waste collection vehicle 12 with the intermediate size container in the fill position. The cover 56 is then opened and the divided cart 16 is placed on the lift mechanism 98 so that the cart hook 120*b* is received within the inset 62 and engages the grab handle 64. The lift mechanism 98 is then actuated so that the first lifting plate 100 pivots about the hinge connection between the support arms 102, 104, 106 and the front walls 78, 80 until the divided cart 16 is partially inverted (emptying position) and the divider wall 50 of the divided cart aligns with the peak of the deflector blades 132, 134. As the contents from the first compartment 52 and second compartment 54 of the divided cart 16 empty into the corresponding first compartment 70 and second compartment 72 of the intermediate size container 14, the deflectors will deflect any waste adjacent the divider wall of the container cart into the appropriate compartment of the intermediate size container 14. This process is repeated for multiple divided carts until the intermediate size container 14 is full or it is desired to empty the contents of the intermediate size container into the waste collection vehicle 12.

Although only the description of a divided cart containing segregated waste has been described, the process for emptying a divided cart with both compartments filled with a single type of waste is similar to that described above except that the divided cart is mounted to the cart hook 118*b* or 120*b* as appropriate.

To empty the contents of the intermediate size container 14 into the waste collection vehicle 12, the hydraulic lift 26 of the waste collection vehicle 12 is actuated so that the arms 28 are rotated about rotational axis 29 and the divided cart is lifted towards the hopper 27 and partially inverted. As the intermediate size container 14 is moved to a partially inverted position (the emptying position), the divider wall 20 is received between the trailing edges 140, 142 of the blades 132, 134, effectively sealing the divider wall of the intermediate size container 14 relative to the divider wall 20 of the storage container 18. The tapered opening defined by the trailing edges of the blades helps to ensure the divider wall 20 is received between the blades because the intermediate size container 14 is often jostled side-to-side in response to the non-steady movement of the arms 28.

Typically, the divider wall 20 is knife-edged so that as it is received in the tapered opening between the blades 132, 134, the divider wall deflects the blades to a greater distance as the intermediate size container is inverted. The divider wall 20 effectively "un-zips" the blades, with each blade being positioned on an opposite side of the divider wall 20 to function as a seal between and deflector for the aligned compartments 70, 22 and 72, 24 of the intermediate size container and storage container. The resiliency of the blades 132, 134 permits the blades 132, 134 to resiliently spread as the divider wall is forced in-between the blades 132, 134.

In the partially inverted position (emptying position), the first and second compartments, 70, 72 of the intermediate size container 14 align with the first and second compartments 22, 24 of the waste storage container 18, respectively, and the contents of the intermediate size container compartments empty into the aligned compartments of the waste storage container 18. The hydraulic actuators 30 are then actuated to further invert the intermediate size container 14 to ensure complete transfer of the contents from the intermediate size container 14 into the waste storage container 18.

After the contents of the intermediate size container 14 have been emptied into the waste storage container 18, the intermediate size container 14 is lowered back toward the ground by reversing the direction of rotation of the lift arms 28 of the hydraulic lift 26. As the intermediate size container 14 is lowered, the blades 132, 134 flex back to their original position where they form a triangular deflector for the divided cart 16.

An advantage of the segregated waste collection system according to the invention is that the design and operation of the divided cart 16 is simplified with a single cover, especially when the divided cart 16 has more than two compartments.

Figure 8:
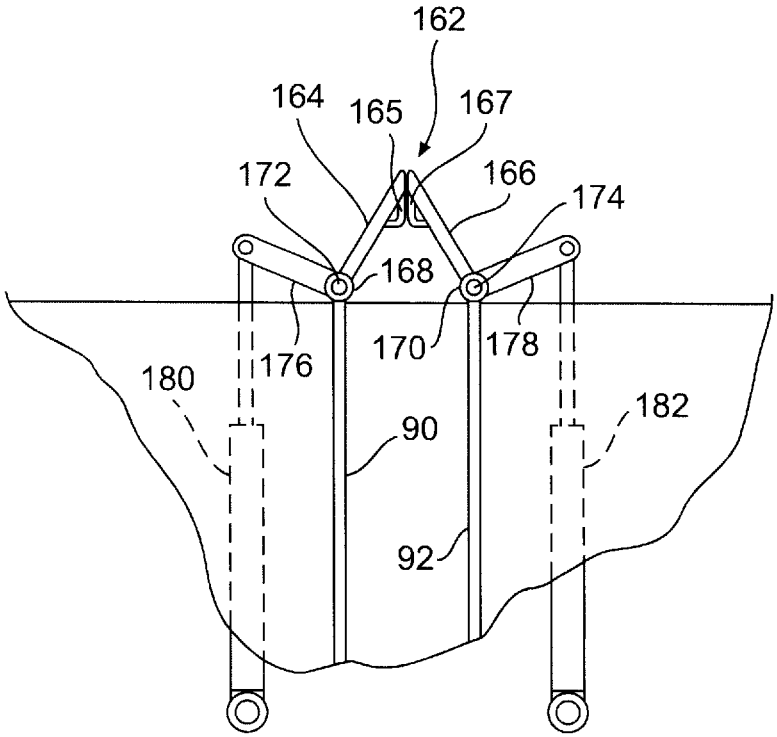
FIG. 8 illustrates a second embodiment of the deflectors shown in the filling position.

FIG. 8 illustrates an alternative embodiment of the invention wherein like numerals will be used to identify like parts. Alternative deflectors 162 comprise opposed deflector plates 164, 166 each of which have longitudinal supports 165, 167 and are pivotally mounted to interior side walls 90, 92 by hinges 168, 170, respectively. Deflector plate 166 is rigidly mounted to a lever arm 178 through a hinge pin 174. Likewise, deflector plate 164 is rigidly mounted to lever arm 176 through a hinge pin 172. The hinge pins 172, 174 are pivotally mounted in sockets in the hinges 168 and 170 for pivotal movement of the deflector plates 164, 166 with respect to the walls 90, 92. The lever arms 176, 178 are mounted at other end to actuators 180, 182, respectively. The actuators 180, 182 are preferably pneumatic actuators, although any suitable type of actuator can be used.

Figure 9:
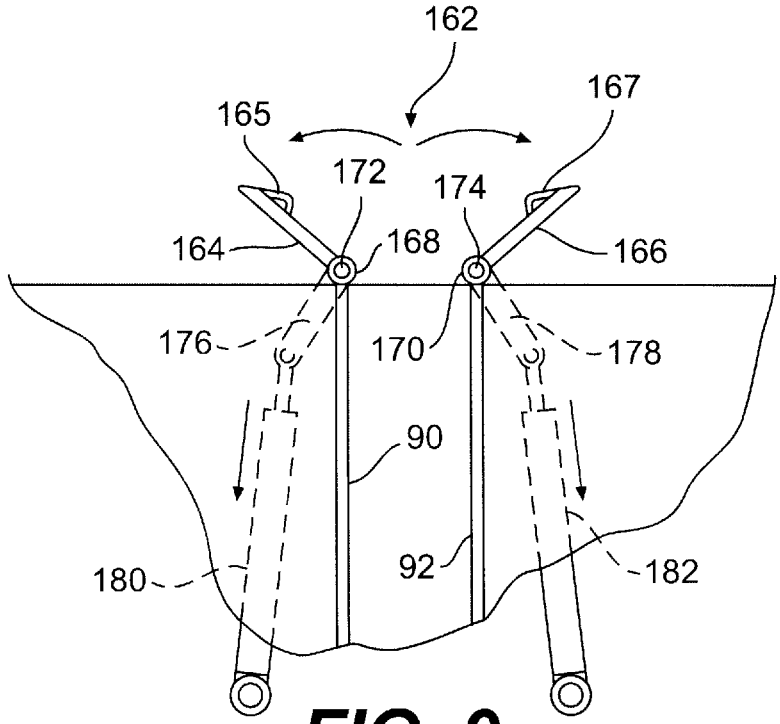
FIG. 9 illustrates the second embodiment of the deflectors in an emptying position.

The actuators 180, 182 rotate the lever arms 176, 178 to move the deflector plates 164, 166 from their filling position (FIG. 8), in which their upper ends meet to form an inverted V-shaped deflector, to an emptying position (FIG. 9), in which the deflectors 162, 164 are rotated away from each other.

The operation of the segregated waste collection system using the alternative deflectors is substantially identical as described above with the preferred deflectors. The only difference is that as the intermediate size container is moved from the fill position to the emptying position, the deflector plats 164, 166 must be moved from their fill position (FIG. 8) to their emptying position (FIG. 9) by actuation of the actuators 180, 182. The actuators are preferably actuated by a proximity switch encountered by the lift arms 28 as they are rotated. However, any suitable way can be used to automatically or manually actuate the actuators 180, 182.

Figure 10:
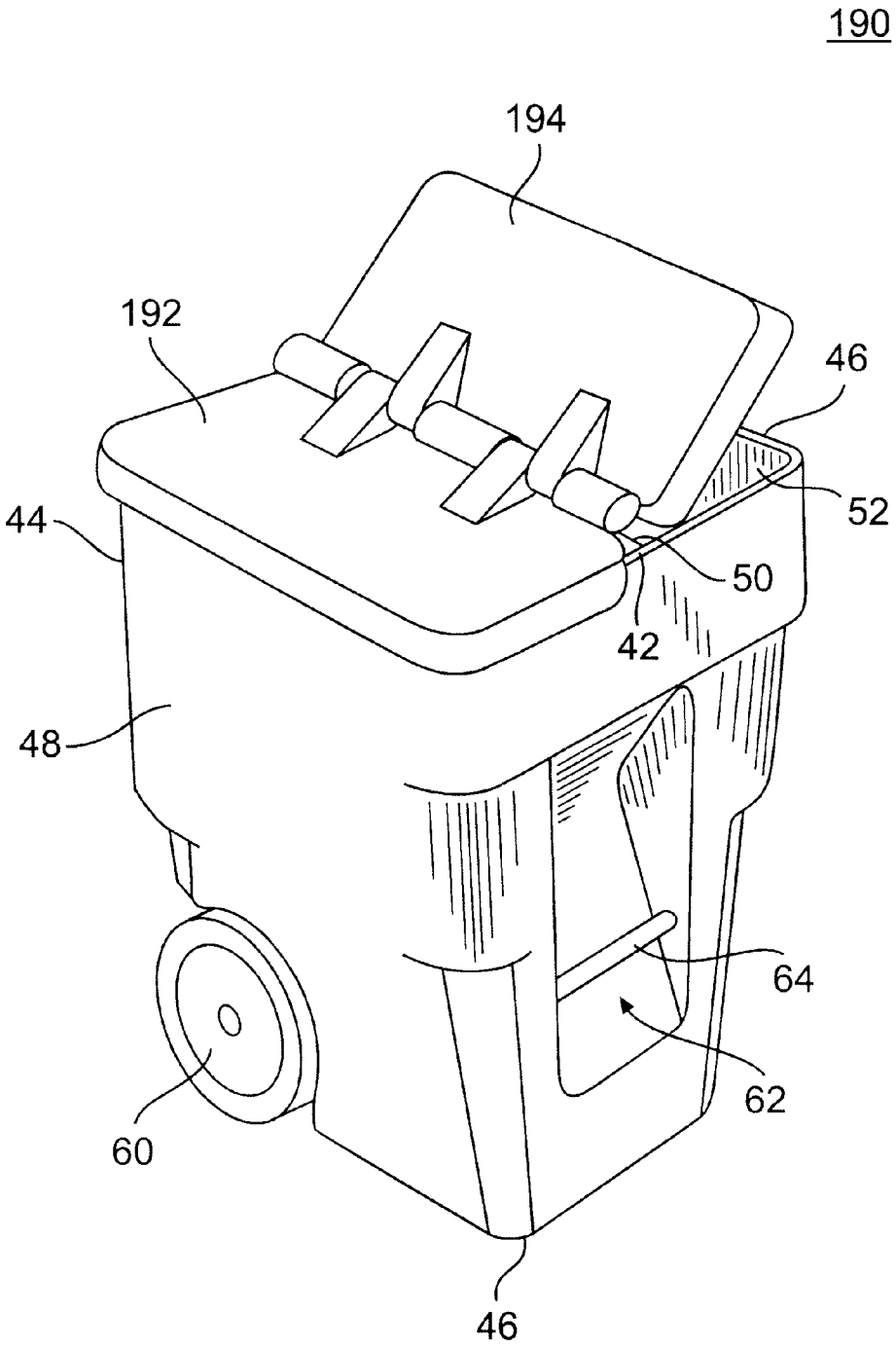
FIG. 10 illustrates an alternative embodiment of a divided cart.
Figure 11:
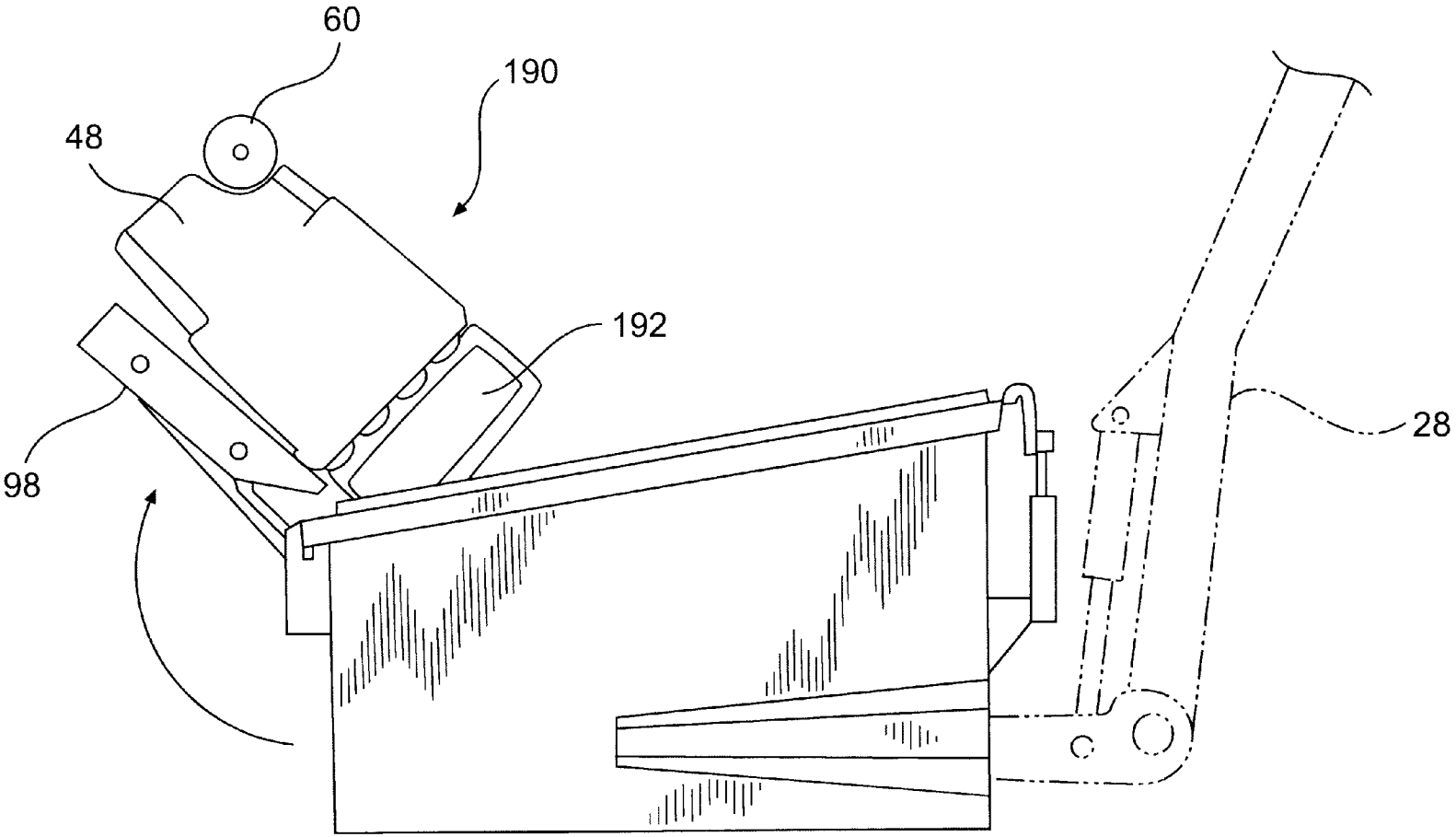
FIG. 11 illustrates the alternative embodiment divided cart mounted to the intermediate size container in the emptying position.

FIGS. 10 and 11 illustrate a second embodiment of the divided cart 16. Like numbers will be used to identify like numbers of the segregated waste collection system 10 when describing the alternative cart 190. The alternative cart 190 is substantially identical to the divided cart 16 except that the single cover 56 of the divided cart 16 is replaced by multiple covers 192, 194 corresponding to each of the compartments 52 and 54. The covers 192 and 194 are hingedly mounted to the divider wall 50.

The operation of the segregated waste collection system with the alternative cart 190 is substantially identical as described above for the preferred divided cart 16, except that the covers 192 and 194 are not opened prior to lifting the cart 190. Instead, the covers 192 and 194 remained closed as the cart 190 is lifted to the partially inverted position. As the cart 190 moves to the partially inverted position, the covers 192 and 194 will rotate to open under the force of gravity and lie against the deflectors on the intermediate size container 14 as best illustrated in FIG. 1. When the cart is in the partially inverted position, the covers 192 and 194 supplement the deflective fiction of the deflectors.

While particular embodiments of the invention have been shown, it will be understood that the invention is not limited thereto since modifications may be made by those skilled in the art particularly in light of the foregoing teachings. Reasonable variation and modification are possible within the scope of the foregoing disclosure of the invention without departing from the spirit of the invention.

What is claimed is:

1. A segregated waste collection system for collecting segregated waste from a distant location and moving the collected segregated waste to a centralized collection station while maintaining the segregated state of the waste, the segregated waste collection system comprising:

a portable waste container for use at the distant location, said portable waste container being able to be transferred to and from multiple locations, said container comprising a bottom wall from which extends a peripheral wall to define a waste receiving chamber and a divider disposed within said waste receiving chamber to divide said waste receiving chamber into two waste compartments, with each waste compartment capable of receiving different types of waste to thereby segregate the waste;

a transfer container comprising a base from which extends a peripheral wall to define a transfer chamber and a divider disposed within the transfer chamber to divide the transfer chamber into two transfer compartments, with each of the transfer compartments in said waste container;

a collection vehicle comprising a storage container and a divider disposed within said storage container to divide said storage container into two storage compartments, each of said storage compartments corresponding to one of said two transfer compartments, and comprising a loading mechanism for carrying said transfer container, operable between a transfer position in which said transfer container is positioned to receive contents of said waste container, and a dumping position in which said transfer container is positioned to dump its contents into said storage container; and a deflector assembly on said transfer container, aligned with said transfer container divider and movable between a fill position to deflect contents of said waste container from said waste compartments into corresponding transfer compartments when said waste container is at least partially inverted over said transfer container and said transfer container is in said transfer position thereof, and a dump position to deflect the contents of said transfer compartments into corresponding storage compartments when said transfer container is in said dumping position thereof, to thereby maintain the segregated status of the waste from said waste container to said storage container.

2. A segregated waste collection system as in claim 1, wherein said deflector assembly comprises a pair of opposing vanes.

3. A segregated waste collection system as in claim 2, wherein said vanes have a wedge-shaped profile that converges as said vanes extend away from said transfer container.

4. A segregated waste collection system as in claim 2, wherein each of said vanes respectively has an inner edge and an outer edge with such inner edges extending along said transfer container divider, and with such outer edges spaced above said transfer container divider.

5. A segregated waste collection system as in claim 4, wherein said vane outer edges are spaced with respect to each other to define a gap that receives said waste container divider when said transfer container is in said transfer position thereof, and that receives said storage container divider when said transfer container is in said dumping position thereof.

6. A segregated waste collection system as in claim 5, wherein said vanes are made from a flexible material and said gap is defined so that said vanes are flexed slightly outward when one of said waste container divider and said storage container divider are received within said gap, so as to form a substantially continuous barrier between said transfer container divider and the one of said waste container divider and said storage container divider.

7. A segregated waste collection system as in claim 6, wherein each of said vanes has opposing ends connecting said inner and outer edges and each of said ends has a generally increasing height as measured from the distance between said inner and outer edges, and wherein said vanes are positioned relative to said transfer container so that they have an overall outwardly converging profile, such that the space between corresponding ends of said vanes decreases toward said outer edges to define a wall insertion guide to aid in directing one of said waste container divider and said storage container divider between said vanes.

8. A segregated waste collection system as in claim 7, wherein said storage container divider comprises a wall having a pointed edge that is received within said wall insertion guide as said transfer container is moved to said dumping position thereof, and wherein said pointed edge aids is deflecting said vanes.

9. A segregated waste collection system as in claim 7, wherein said vanes are comprised of a resilient material so as to be resiliently deflected by said pointed edge.

10. A segregated waste collection system as in claim 7, wherein said inner edge of each of said vanes is mounted to said transfer container divider wall.

11. A segregated waste collection system as in claim 10, wherein said vanes are removably mounted to said transfer container divider wall for easy replacement of said vanes.

12. A segregated waste collection system as in claim 1, further comprising a lift mechanism mounted to said transfer container for lifting said waste container into a transfer container filling position thereof relative to said transfer container.

13. A segregated waste collection system as in claim 12, wherein said lift mechanism comprises a first lifting plate for positioning of said waste container on said lift mechanism so that when said waste container is in said transfer container filling position thereof, said waste container compartments are aligned with corresponding transfer container compartments.

14. A segregated waste collection system as in claim 13, wherein said transfer container is removably carried by said loading mechanism.

15. A segregated waste collection system as in claim 13, wherein:

said first lifting plate defines a notch therein for aligned receipt of said deflector assembly whenever said waste container is in said transfer container filling position thereof; and wherein said lift mechanism includes a second lifting plate, with said first and second lifting plates including multiple saddles for receiving respective waste containers with at least one waste compartment each aligned such that said lift mechanism can dump contents of such respective waste containers into respective of said transfer compartments.

16. A segregated waste collection system for collecting segregated waste from a distant location and moving the collected segregated waste to a centralized collection station while maintaining the segregated state of the waste, the segregated waste collection system comprising;

an intermediate transfer container comprising a transfer chamber with at least one divider wall disposed within the transfer chamber to divide said transfer chamber into multiple transfer compartments;

a collection vehicle comprising a storage container with at least one divider disposed within said storage container to divide said storage container into multiple storage compartments respectively corresponding with said multiple transfer compartments, and further comprising a loading mechanism carrying said transfer container and operable between a receiving position material, and a dumping position in which said transfer container is positioned to dump its contents into said storage container; and a deflector assembly on said transfer container, said deflector assembly being in mechanical communication with a pair of actuators and is further aligned with said transfer container divider and movable between a fill position to guide waste into respective transfer compartments when said transfer container is in said transfer position thereof, and a dump position to guide contents from said transfer compartments into said corresponding storage compartments when said transfer container in said dumping position so as to thereby maintain segregated status of waste from the distant location to said storage container of said collection vehicle, said actuators causing said deflector assembly to be movable between said fill position and said dump position.

17. A segregated waste collection system as in claim 16, wherein said deflector assembly comprises a pair of opposing vanes, each vane respectively having an inner edge and an outer edge, with such inner edges extending along said transfer container at least one divider wall, and with such outer edges spaced above said transfer container at least one divider wall.

18. A segregated waste collection system as in claim 17, wherein said transfer chamber has one divider wall and two resulting transfer compartments, and said vehicle storage container correspondingly has one divider and two resulting corresponding storage compartments.

19. A segregated waste collection system as in claim 18, wherein said vane outer edges are spaced with respect to each other to define a gap that receives said storage container at least one divider wall when said transfer container is in said dumping position thereof.

20. A segregated waste collection system as in claim 19, wherein said vanes are made from a flexible material and said gap is defined so that said vanes are flexed slightly outward whenever said storage container at least one divider is received within said gap, so as to form a substantially continuous barrier between said transfer container at least one divider wall and said storage container divider.

21. A segregated waste collection system as in claim 20, wherein each of said vanes has opposing ends connecting said inner and outer edges and each of said ends has a generally increasing height as measured from the distance between said inner and outer edges, and wherein said vanes are positioned relative to said transfer container so that they have an overall outwardly converging profile, such that the space between corresponding ends of said vanes decreases toward said outer edge to define a wall insertion guide to aid in directing said at least one storage container divider wall between said vanes.

22. A segregated waste collection system as in claim 21, wherein said storage container at least one divider wall comprises a wall having a pointed edge that is received within said wall insertion guide as said transfer container is moved to said dumping position thereof, and wherein said pointed edge aids in deflecting said vanes.

23. A segregated waste collection system as in claim 16, wherein said transfer container is removably carried by said loading mechanism.

24. An intermediate transfer container for use in a segregated waste collection system of the type having a waste container located at a distant location, a collection vehicle for moving collected segregated waste to a centralized collection station, and with the intermediate transfer container used for transferring the waste from the waste container to the collection vehicle while maintaining the segregated state of the waste, with such waste container having a waste receiving chamber divided by a divider wall into two waste compartments for segregated waste, and with the collection vehicle having a storage container divided by a divider into two waste compartments for segregated waste, each corresponding respectively to one of two transfer compartments of the transfer container, and a loading mechanism for carrying the intermediate transfer container and operable between a transfer position in which the transfer container is positioned to receive the contents of the waste container, and a dumping position in which the transfer container is positioned to dump its contents into the storage container, said intermediate transfer container comprising:

a base from which extends a peripheral wall to define a transfer chamber, with a divider disposed within said transfer chamber so as to divide said transfer chamber into two transfer compartments, each of said transfer compartments corresponding with a different one of the two waste compartments; and a deflector assembly mounted on said transfer container divider and movable between a fill position thereof in which said deflector assembly is positioned to guide waste from a waste container compartment to a corresponding transfer compartment when said transfer container is in the transfer position thereof, and a dump position in which said deflector assembly is positioned to guide contents from said transfer compartments into corresponding storage compartments when said transfer container is in the dumping position, to thereby maintain the segregated status of the waste from the waste container to the storage container, said deflector assembly comprising a pair of blades, said pair of blades defining a pair of leading edges and a pair of trailing edges, said pair of trailing edges being gently sloped and proximal to said collection vehicle, said gentle slope of said trailing edges aiding in the positioning of said divider wall.

25. A transfer container as in claim 24, wherein said deflector assembly comprises a pair of flexible, resilient opposing vanes.

26. A transfer container as in claim 25, wherein each of said vanes has an inner edge and an outer edge, with such inner edges extending along said transfer container divider, and such outer edges spaced above said transfer container divider.

27. A transfer container as in claim 26, wherein said vanes are flexed slightly outward when one of said waste container divider and said storage container divider are received between said vanes to form a substantially continuous barrier between said transfer container divider and one of such other dividers when said transfer container is in one of the corresponding transfer and dumping positions.

* * * * *